US008297914B2

(12) United States Patent
Chang et al.

(10) Patent No.: US 8,297,914 B2
(45) Date of Patent: Oct. 30, 2012

(54) FAN WITH IMPELLERS COUPLED IN SERIES AND FAN FRAME THEREOF

(75) Inventors: Shun-Chen Chang, Taoyuan Hsien (TW); Yi-Ching Chiu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1114 days.

(21) Appl. No.: 11/949,488

(22) Filed: Dec. 3, 2007

(65) Prior Publication Data

US 2008/0138191 A1 Jun. 12, 2008

(30) Foreign Application Priority Data

Dec. 8, 2006 (TW) ..... 95145992 A

(51) Int. Cl.
*F04D 25/16* (2006.01)

(52) U.S. Cl. ..... 415/66; 415/69; 415/100

(58) Field of Classification Search ..... 415/60, 415/66, 68, 69, 99, 100, 98; 417/423.5, 350, 417/354, 360

See application file for complete search history.

(56) References Cited

U.S. PATENT DOCUMENTS 7,112,905 B2 * 9/2006 Chang et al. ..... 310/112

* cited by examiner

*Primary Examiner* — Dwayne J White

(74) *Attorney, Agent, or Firm* — Birch, Stewart, Kolasch & Birch, LLP

(57) ABSTRACT

A fan includes a fan frame, a front impeller and a rear impeller. The fan frame has a frame body and a plurality of connecting elements. The front impeller has a first bushing disposed at the central portion of the frame body. Two ends of each connecting element are respectively connected with the frame body and the first bushing. The rear impeller has a second bushing partially telescoped into the first bushing.

20 Claims, 3 Drawing Sheets

FAN WITH IMPELLERS COUPLED IN SERIES AND FAN FRAME THEREOF

CROSS REFERENCE TO RELATED APPLICATIONS

This Non-provisional application claims priority under 35 U.S.C. §119(a) on Patent Application No(s). 095145992 filed in Taiwan, Republic of China on Dec. 8, 2006, the entire contents of which are hereby incorporated by reference.

BACKGROUND OF THE INVENTION

1. Field of Invention

The invention relates to a fan with multiple impellers coupled in series and a fan frame thereof. In particularly, the invention relates to a fan with dual impellers coupled in series, which has a single fan frame, and a fan frame thereof.

2. Related Art

The electronic products have been rapidly developed towards more compact and higher performance, frequency and operation speed, which accompany the increased heat. The increased heat causes the unstable issue of the electronic products and further affects the reliability and lifetime of the electronic products. Thus, the heat dissipation issue has become one of the important subjects of the electronic products. Fans are frequently used heat dissipating devices in the electronic products. Moreover, in order to enhance the heat dissipating efficiency, several fans are connected in series to form a fan with multiple impellers so as to increase the air quantity and pressure of the airflow.

As shown in FIG. 1, a conventional fan 1 includes a front impeller 11, a front fan frame 12, a rear impeller 13 and a rear fan frame 14. The front impeller 11 is disposed in the front fan frame 12 and telescoped to a bushing 121 of the front fan frame 12. The rear impeller 13 is disposed in the rear fan frame 14 and telescoped to a bushing 141 of the rear fan frame 14. The front and rear impellers 11, 13 are connected in series. In addition, the fan 1 has a fixing element 15, such as a tenon, a screw or a rivet, to fasten the front fan frame 12 and the rear fan frame 14. Accordingly, when the front and rear impellers 11, 13 are operated simultaneously, the fan 1 can generate the airflow with increased air quantity and pressure so as to enhance the heat dissipating efficiency.

However, after the fan 1 rotates under a high speed for a long period, the fixing element 15 may be unstable due to the torque of the rotating impellers. The unstable fixing element 15 will cause the vibrations, which may damage the sensitive components of the electronic products. Moreover, if the fixing element 15 is loosened, the front and rear fan frames 12, 14 will separate from each other. This will lead to the malfunction of the fan 1, and further cause the shut down or break down of the electronic product because the heat can not be dissipated in time.

Again referring to FIG. 1, since the fan 1 is composed of two fan frames 12 and 14, the ribs 122 and 142 must be longer or thicker to provide sufficient structural strength. Thus, the frame thickness D of the fan 1 is larger, so that the size of the fan 1 increases. Therefore, the usable space of the electronic product with the fan 1 is decreased, so the product competitiveness thereof may be lower.

Therefore, it is an important subject to provide a fan with multiple impellers and fan frame thereof that can prevent the problems of unstable connection and loosening, increase the structural strength, reduce the cost of material and assembling, decrease the size and enhance the product performance.

SUMMARY OF THE INVENTION

In view of the foregoing, the invention is to provide a fan with multiple impellers and fan frame thereof that can prevent the problems of unstable connection and loosening, increase the structural strength, reduce the cost of material and assembling, decrease the size and enhance the product performance.

To achieve the above, the invention discloses a fan frame of a fan with dual impellers. The fan includes a first bushing and a second bushing partially telescoped into the first bushing. The fan frame includes a frame body and a plurality of connecting elements. The first bushing is disposed at the central portion of the frame body. The two ends of each connecting element are connected with the frame body and the first bushing.

To achieve the above, the invention also discloses a fan including a fan frame, a front impeller and a rear impeller. The fan frame includes a frame body and a plurality of connecting elements. The front impeller has a first bushing disposed at the central portion of the frame body. The two ends of each connecting element are connected with the frame body and the first bushing. The rear impeller has a second bushing partially telescoped into the first bushing.

As mentioned above, the fan frame of the invention is a single piece, and the front and rear impellers are respectively disposed at two ends of the fan frame. Compared with the prior art, the fan and fan frame of the invention can prevent the unstable connection and loosening of the conventional fan frame. The connecting elements of the invention are formed with the frame body in a single piece to increase the structural strength, enhance the product performance and decrease the thickness of the fan frame. Accordingly, the size of the fan of the invention can be reduced. Moreover, the fixing elements used in the conventional fan are unnecessary, so the costs of the molds, material and assembling can be reduced.

BRIEF DESCRIPTION OF THE DRAWINGS

The present invention will become more fully understood from the detailed description and the accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
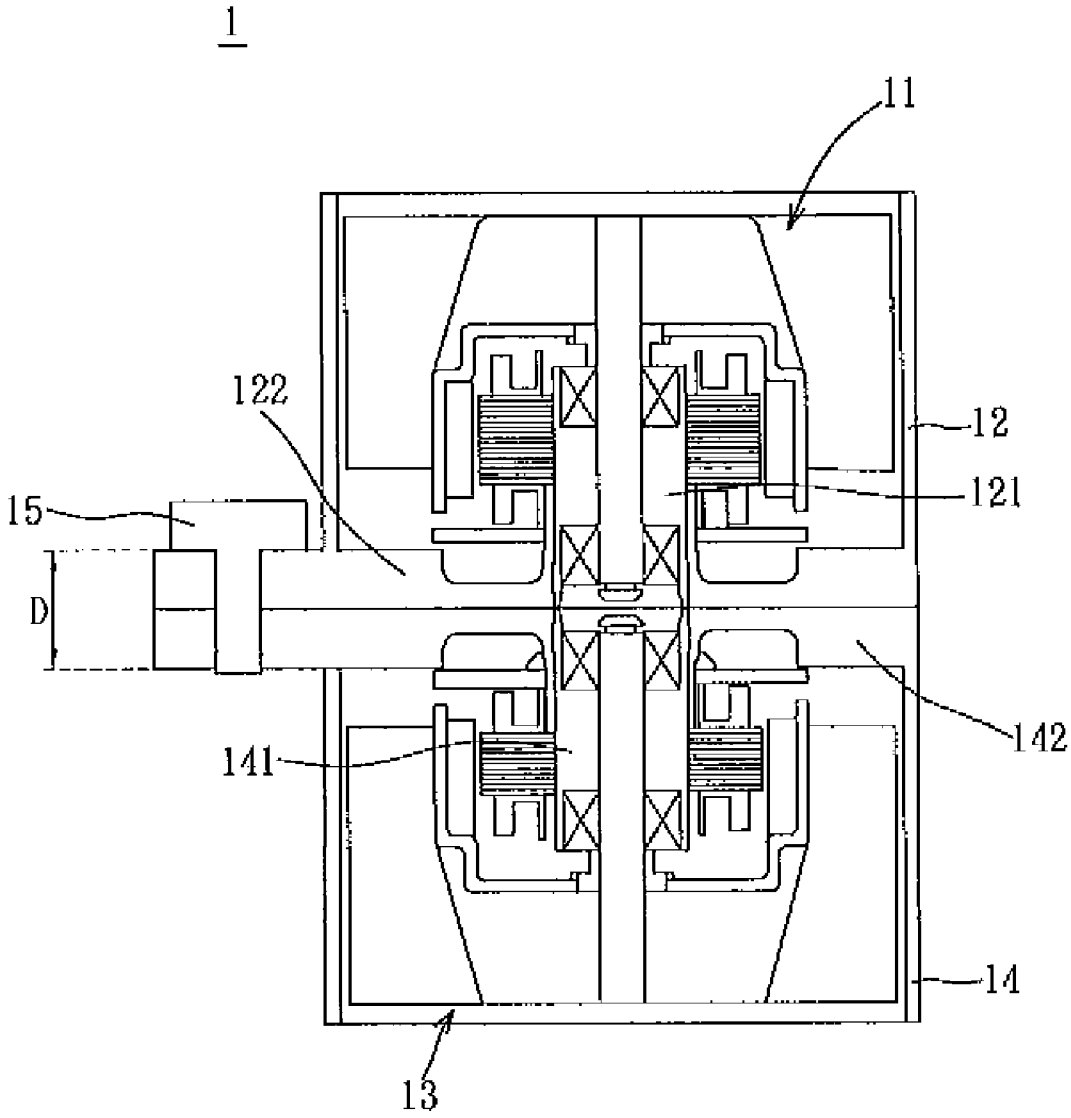
FIG. 1(PRIOR ART)
FIG. 1 is a cross-sectional diagram showing a conventional fan with two impellers connected to each other.
Figure 2:
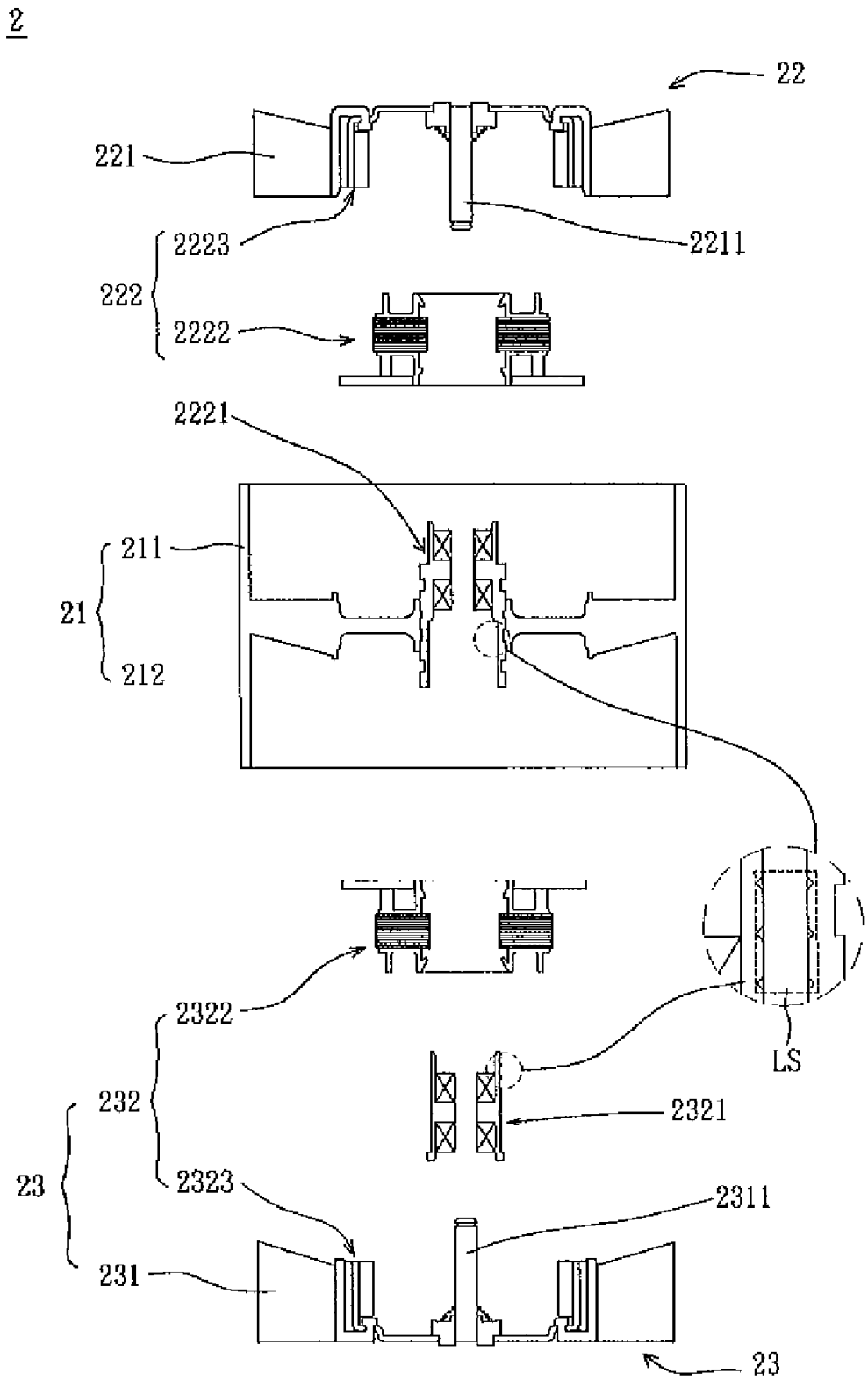
FIG. 2 is an exploded diagram of a fan with dual impellers according to an embodiment of the invention.

Referring to FIG. 2, a fan 2 according to an embodiment of the invention includes a fan frame 21, a front impeller 22 and a rear impeller 23. The fan frame 21 has a frame body 211 and a plurality of connecting elements 212, which are connected with the frame body 211 by hooking, engaging, locking or adhering. Alternatively, the connecting elements can be integrally formed with the frame body 211 as a single piece. In addition, the connecting element 212 can be a rib or a stationary blade.

The front impeller 22 has a plurality of blades 221 and is driven by a motor 222, which includes a stator 2222 and an impeller 2223. The fan 2 further includes a first bushing 2221 disposed at the central portion of the frame body 211. The two ends of each connecting element 212 are connected with the frame body 211 and the first bushing 2221, respectively. The first bushing 2221 accommodates at least one bearing, such as a ball bearing, a sleeve bearing or a fluid bearing. The first bushing 2221 and the fan frame 21 can be integrally formed by insertion molding.

The stator 2222 has a coil, and the rotor 2223 has a magnetic ring. The front impeller 22 has a shaft 2211 connecting with the rotor 2223 and passing through the first bushing 2221. Based on the electromagnetic effect between the coil and the magnetic ring, the rotor 2223 can be rotated so as to drive the front impeller 22. As shown in FIG. 2, the motor 222 is disposed in the hub of the front impeller 22, so that the motor 222 can drive the front impeller 22 to rotate.

The rear impeller 23 has a plurality of blades 231 and is driven by another motor 232 having a stator 2322 and a rotor 2323. The fan 2 further includes a second bushing 2321, which is partially telescoped into an extending part of the first bushing 2221. The second bushing 2321 accommodates at least one bearing. The extending part of the first bushing 2221 passes through the connecting element 212. In the embodiment, the second bushing 2321 can be connected with the first bushing 2221 by hooking, engaging, locking or adhering. In addition, as shown in the enlarged portion of FIG. 2, a limiting structure LS is disposed at the junction of the first bushing 2221 and the second bushing 2321, which is the contact portions of the inner surface of the first bushing 2221 and the outer surface of the second bushing 2321. In the embodiment, the limiting structures LS are the corresponding recesses, and glue can be applied to the recesses to strengthen the bonding therebetween. Alternatively, the limiting structure LS can be a thread structure for connecting the first bushing 2221 with the second bushing 2321.

The stator 2322 has a coil, and the rotor 2323 has a magnetic ring. The rear impeller 23 has a shaft 2311 connecting with the rotor 2323 and passing through the second bushing 2321. Based on the electromagnetic effect between the coil and the magnetic ring, the rotor 2323 can be rotated so as to drive the rear impeller 23. As shown in FIG. 2, the motor 232 is disposed in the hub of the rear impeller 23, so that the motor 232 can drive the front impeller 23 to rotate.

Figure 3:
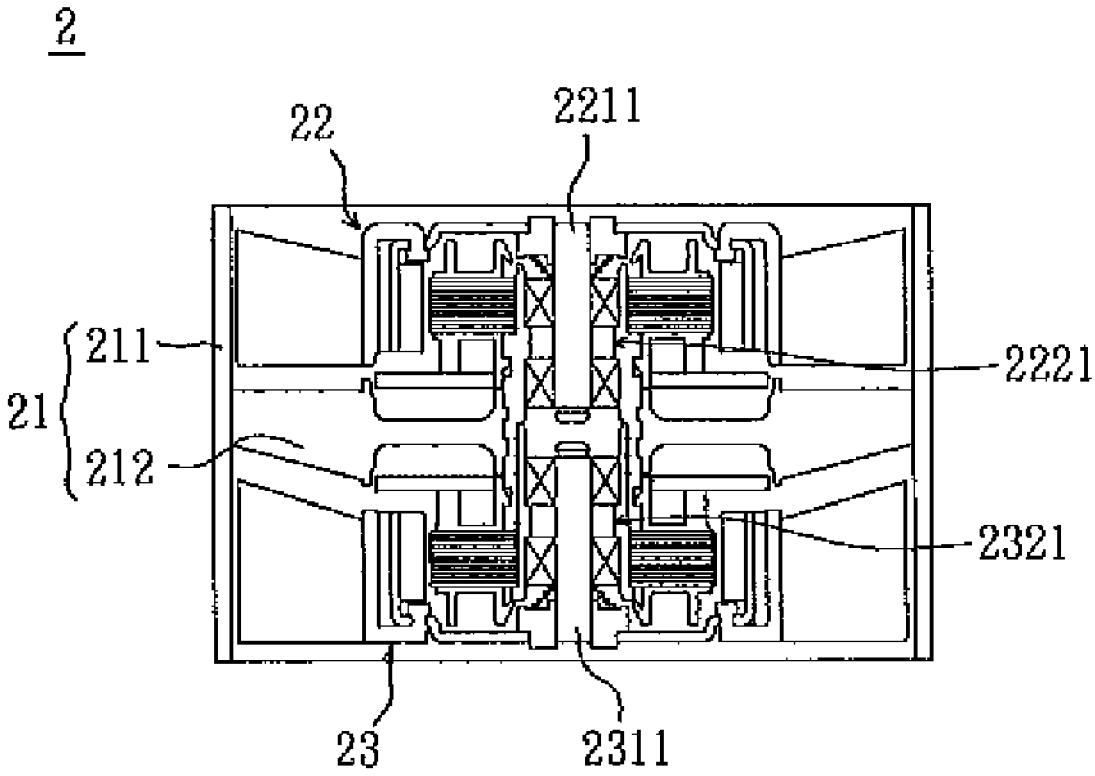
FIG. 3 is a cross-sectional view of the assembled fan of FIG. 2.

Referring to FIG. 3, after the fan 2 is assembled, the front and rear impellers 22, 23 are disposed in the fan frame 21 in series. The front and rear impellers 22, 23 are disposed at opposite ends of the frame body 211. The shafts 2211 and 2311 pass through the first and second bushings 2221, 2321, respectively. The connecting elements 212 are located between the front and rear impellers 22, 23. When the fan 2 operates, the front and rear impellers 22, 23 rotate in series so as to increase the air quantity and pressure of the airflow. The amount, position, shape and angle of the connecting elements 212 can be modified depending on the actual requirements, and the connecting elements 212 can be used as the air-guiding structures. For example, the connecting elements 212 can be ribs or stationary blades for further increasing the air quantity and pressure of the airflow. The impellers 22 and 23 illustrated in the embodiment are only an example and not the limitation of the invention.

In summary, the fan frame of the invention is an integral component, and the front and rear impellers are respectively disposed at two ends of the fan frame. Compared with the prior art, the fan and fan frame of the invention can prevent the unstable connection and loosening of the conventional fan frame. The connecting elements of the invention are integrated with the frame body to increase the structural strength, enhance the product performance and decrease the thickness of the fan frame. Accordingly, the size of the fan of the invention can be reduced. Moreover, the fixing elements used in the conventional fan are unnecessary, so the costs of the molds, material and assembling can be reduced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan frame comprising:

a first bushing;

a second bushing partially telescoped into and directly in contact with an extending part of the first bushing;

a frame body for accommodating the first bushing therein;

a connecting element connected with the frame body and the first bushing, wherein the extending part passes beyond both ends of the connecting element; and a glue disposed at the junction of the extending part and the second bushing to strengthen the bonding of the first and second bushing, wherein the glue is applied to corresponding recesses of the inner surface of the extending part and the outer surface of the second bushing.

2. The fan frame according to claim 1, wherein the frame body and the connecting element are integrally formed with the first bushing as a single piece.

3. The fan frame according to claim 2, wherein the frame body and the connecting element are formed with the first bushing by insertion molding.

4. The fan frame according to claim 1, wherein the fan body and the connecting element are formed as a single piece.

5. The fan frame according to claim 1, wherein the connecting element is connected with the fan frame by hooking, engaging, locking or adhering.

6. The fan frame according to claim 1, wherein the connecting element is a rib, stationary blade or air-guiding structure.

7. A fan comprising:

a fan frame having a connecting element;

a first bushing disposed in the fan frame, wherein the frame body and the first bushing are connected via the connecting element;

a second bushing partially telescoped into and directly in contact with an extending part of the first bushing;

a first impeller coupled to the first bushing;

a second impeller coupled to the second bushing, wherein the extending part passes beyond both ends of the connecting element; and a glue disposed at the junction of the extending part and the second bushing to strengthen the bonding of the first and second bushing, wherein the glue is applied to corresponding recesses of the inner surface of the extending part and the outer surface of the second bushing.

8. The fan according to claim 7, wherein the first impeller and the second impeller are disposed in the fan frame in series.

9. The fan according to claim 7, wherein the connecting element is located between the first impeller and the second impeller.

10. The fan according to claim 7, wherein the frame body and the connecting element are integrally formed with the first bushing as a single piece.

11. The fan according to claim 10, wherein the frame body and the connecting element are formed with the first bushing by insertion molding.

12. The fan according to claim 7, wherein the fan body and the connecting element are formed as a single piece.

13. The fan according to claim 7, wherein the connecting element is connected with the fan frame by hooking, engaging, locking or adhering.

14. The fan according to claim 7, wherein the connecting element is a rib, stationary blade or air-guiding structure.

15. The fan according to claim 7, wherein the second bushing is connected with the first bushing by hooking, engaging, locking or adhering.

16. The fan according to claim 7, further comprising a limiting structure disposed on a junction of the first bushing and the second bushing.

17. The fan according to claim 7, wherein the first bushing and the second bushing accommodate at least one bearing therein, respectively.

18. The fan according to claim 17, wherein the bearing is a ball bearing, sleeve bearing or fluid bearing.

19. The fan according to claim 7, further comprising a first motor disposed in a hub of the first impeller for driving the first impeller to rotate.

20. The fan according to claim 19, further comprising a second motor disposed in a hub of the second impeller for driving the second impeller to rotate.

* * * * *